US009192237B2

(12) United States Patent
Bachar

(10) Patent No.: US 9,192,237 B2
(45) Date of Patent: Nov. 24, 2015

(54) SEAT BACK, SEATING APPARATUS AND METHOD

(71) Applicant: Offer Bachar, Toronto (CA)

(72) Inventor: Offer Bachar, Toronto (CA)

(73) Assignee: Airopedic International Inc., Toronto (CA)

( * ) Notice: Subject to any disclaimer, the term of this patent is extended or adjusted under 35 U.S.C. 154(b) by 2 days.

(21) Appl. No.: 13/910,505

(22) Filed: Jun. 5, 2013

(65) Prior Publication Data

US 2014/0117732 A1 May 1, 2014

Related U.S. Application Data

(60) Provisional application No. 61/721,254, filed on Nov. 1, 2012.

(51) Int. Cl.

| | |
|---|---|
| ***A47C 3/00*** | (2006.01) |
| ***A47C 7/14*** | (2006.01) |
| ***A47C 7/46*** | (2006.01) |
| *A47C 7/44* | (2006.01) |
| *A47C 7/40* | (2006.01) |

(52) U.S. Cl.

CPC . *A47C 7/46* (2013.01); *A47C 7/402* (2013.01); *A47C 7/445* (2013.01); *A47C 7/40* (2013.01); *A47C 7/44* (2013.01)

(58) Field of Classification Search

CPC ..... A61G 5/10; A61G 5/12; A61H 1/0274; A47C 7/40; A47C 7/44

USPC ..... 297/285, 284.4, 291, 295, 301.1, 297/452.31, 452.36, 452.15, 452.46, 297/452.56, 284.1, 230.12

See application file for complete search history.

(56) References Cited

U.S. PATENT DOCUMENTS

| | | | | | |
|---|---|---|---|---|---|
| 3,512,835 | A | * | 5/1970 | Flototto | 297/452.14 |
| 4,556,254 | A | * | 12/1985 | Roberts | 297/452.36 |
| 4,643,481 | A | | 2/1987 | Saloff et al. | |
| 4,753,480 | A | | 6/1988 | Morell | |
| 5,369,828 | A | | 12/1994 | Graebe | |
| 5,461,741 | A | | 10/1995 | Graebe | |
| 5,634,685 | A | | 6/1997 | Herring | |
| 5,678,891 | A | | 10/1997 | O'Neill et al. | |
| 5,713,631 | A | | 2/1998 | O'Neill et al. | |
| 5,718,476 | A | * | 2/1998 | De Pascal et al. | 297/284.4 |
| 5,893,184 | A | | 4/1999 | Murphy | |
| 5,997,094 | A | * | 12/1999 | Cvek | 297/452.15 |
| 6,036,271 | A | | 3/2000 | Wilkinson et al. | |
| 6,070,942 | A | | 6/2000 | Barton et al. | |
| 6,209,159 | B1 | | 4/2001 | Murphy | |
| 6,234,578 | B1 | | 5/2001 | Barton et al. | |

(Continued)

*Primary Examiner* — Chi Q Nguyen

(74) *Attorney, Agent, or Firm* — Renner, Otto, Boisselle & Sklar, LLP

(57) ABSTRACT

A flexible resilient seat back, a chair including the seat back and methods of using the chair. The seat back includes an integral sheet material having rigidity sufficient to maintain its shape absent a deforming force; the sheet material having relatively upper and lower portions considered in a direction from top toward bottom, an area of the sheet material approximately at the juncture of the upper and lower portions protruding more forwardly than the major extent of the upper and lower portions, and the sheet material resiliently flexible permitting limited (controlled) deformation during use generally in a prescribed manner in response to force to bend the upper portion of the sheet material relative to the lower portion in a direction front to back and/or in a sidewise direction while supporting the back of the user. A method using and exercising using the chair with seat back.

21 Claims, 8 Drawing Sheets

(56) References Cited

U.S. PATENT DOCUMENTS

| | | | | |
|---|---|---|---|---|
| 6,241,320 | B1 | 6/2001 | Chew et al. | |
| 6,409,268 | B1 * | 6/2002 | Cvek | 297/452.29 |
| 6,502,263 | B1 | 1/2003 | Rowley et al. | |
| D471,042 | S * | 3/2003 | Schmitz et al. | D6/502 |
| 6,551,450 | B1 | 4/2003 | Thomas et al. | |
| 6,623,080 | B2 | 9/2003 | Clapper | |
| 6,755,467 | B1 * | 6/2004 | Chu | 297/284.1 |
| 6,901,617 | B2 | 6/2005 | Sprouse et al. | |
| 6,955,402 | B2 * | 10/2005 | VanDeRiet et al. | 297/452.56 |
| 7,032,971 | B2 * | 4/2006 | Williams | 297/284.4 |
| 7,686,395 | B2 * | 3/2010 | Piretti | 297/297 |
| 7,726,740 | B2 * | 6/2010 | Masunaga | 297/303.3 |
| 8,113,582 | B2 * | 2/2012 | Liu | 297/230.12 |
| 8,113,591 | B2 * | 2/2012 | Cassaday | 297/452.46 |
| D677,068 | S * | 3/2013 | Chen | D6/366 |
| 8,678,499 | B2 | 3/2014 | Kelly | |
| 2004/0160112 | A1 | 8/2004 | Clapper | |
| 2012/0086251 | A1 * | 4/2012 | Parker et al. | 297/285 |
| 2012/0292958 | A1 | 11/2012 | Sprouse, II | |

* cited by examiner

SEAT BACK, SEATING APPARATUS AND METHOD

CROSS-REFERENCE TO RELATED APPLICATION

This application claims the benefit of U.S. Provisional Patent Application Ser. No. 61/721,254, filed Nov. 1, 2012, the entire disclosure of which is hereby incorporated by reference.

TECHNICAL FIELD

The present invention relates generally, as indicated, to a seat back, seating apparatus and method.

BACKGROUND

Many different types of seating apparatus exist. For example, there are chairs (such as office chairs, table chairs typically used at an eating table or counter, wheel chairs, and so on), seats (such as vehicle seats, stadium seats, theater seats, and so on), stools, and so on. Various adjustments have been developed for such seating apparatuses, for example, lumbar support, tilt and height adjustments. These adjustments may improve seating comfort for a user.

Most seating apparatuses have a seat back, sometimes referred to as a back rest. The seat back usually is upstanding in a direction somewhat perpendicular to the chair seat on which a person sits. A person sitting on the chair seat may be guided to "sit up" with his/her back guided by the seat back to a generally vertical orientation. In some seating apparatuses the seat back is rigidly oriented in fixed positional relation to the chair seat, whereby there is virtually possibility for relative movement between the seat back and the chair seat. In other seating apparatuses the seat back may be pivotable relative to the chair seat such that when a person sitting on the chair seat leans backward relative to the forward facing direction of the chair and the person, the seat back may pivot backwards relative to the chair seat. Some seat backs are unpadded and hard, and other seat backs may be more or less padded or cushioned. The conventional seat backs, though usually are themselves of fixed shape or configuration.

SUMMARY

A problem exists with seating apparatuses in that a user seated thereon may become uncomfortable after sitting for a relatively long period of time. To relieve discomfort and/or to relieve stress while seated on a seating apparatus, a user may stretch by leaning back against the seat back, but the only motion possible for a conventional seat back is to pivot backwards relative to the chair seat; this is quite limited motion. If it is convenient and/or permitted, to relieve discomfort after sitting for a period of time, a user may get up from a chair relatively frequently, but this can be a problem, e.g., as follows: In an office environment this may reduce efficiency; at a sporting event the user may miss a spectacular play; in a social event, the user may lose continuity of a particular interaction; and so on.

A need exists to alleviate at least the above problems. A need exists to provide a chair with versatility improvements.

Moreover, many companies and government offices are now implementing regulations to minimize health damages caused by long term seating position and requiring the employees to get up, walk and exercise every so often. For example, in some places there is a requirement for a worker to be permitted to get up, walk and exercise every two hours for five minutes. According to an aspect of the invention the flexible seat back allows a person the option to do stretching and exercise right from the person's seat when desired or needed.

Briefly, according to an aspect of the invention, a seat back provides support and vertical alignment functions for the back of a user and is resiliently flexible to permit limited (controlled) deformation during use generally in a prescribed manner in response to force applied thereto by a user tending to bend an upper portion of the seat back relative to a lower portion of the seat back in a direction front to back and/or in a sidewise direction while supporting the back of the user.

According to another aspect of the invention, a seating apparatus includes a seat, a base, and a seat back that provides support and vertical alignment functions for the back of a user and is resiliently flexible to permit limited (controlled) deformation during use generally in a prescribed manner in response to force applied thereto by a user tending to bend an upper portion of the seat back relative to a lower portion of the seat back in a direction front to back and/or in a sidewise direction while supporting the back of the user.

According to still another aspect of the invention, a method of exercising while seated includes sitting in a seating apparatus that includes a seat back provides support and vertical alignment functions for the back of a user and is resiliently flexible to permit limited (controlled) deformation during use, and using parts of the body to apply pressure to respective portions of the seat back to resiliently deform and to release the sheet back.

Another aspect relates to a seat back, including an integral sheet material having a front and a back and having a top, a bottom, a pair of side edges, and a center portion between the side edges, the sheet material having rigidity sufficient to maintain its shape in the absence of a deforming force, the sheet material having side portions extending from proximity to respective side edges at least part way toward the center portion, the side portions curved concave relative to a forward direction from an area relatively more proximate the center portion toward the respective edges, the sheet material having relatively upper and lower portions considered in a direction from the top toward the bottom, an area of the sheet material approximately at the juncture of the upper and lower portions protruding more forwardly than the major extent of the upper and lower portions, and the sheet material being resiliently flexible to permit limited (controlled) deformation during use generally in a prescribed manner in response to force applied thereto by a user tending to bend the upper portion of the sheet material relative to the lower portion of the sheet material in a direction front to back and/or in a sidewise direction while supporting the back of the user.

According to another aspect, the sheet material is a single sheet of plastic material.

According to another aspect, the sheet material has a lattice structure including open areas and closed areas.

According to another aspect, the thickness of the major extent of the sheet material is at least approximately uniform, and wherein there is a relatively increased thickness of the sheet material at at least part of the perimeter thereof providing strength reinforcement at such perimeter.

According to another aspect, the seat back further includes a forwardly protruding part of the center portion between the top and bottom configured to provide a lumbar support area providing lumbar support for a user.

According to another aspect, the lumbar support area is a gradual smooth transition from the major extent of the sheet material in proximity to the lumbar support to the forwardly protruding part of the center portion of the sheet material.

According to another aspect, the center portion is approximately evenly centered between the side edges.

According to another aspect, the relatively upper portion having a vertical concave curvature relative to the forward direction along a line in a direction from top to bottom of the sheet material and a horizontal concave curvature relative to the horizontal direction generally between the top and bottom of the sheet material; and the relatively lower portion having a vertical concave curvature relative to the forward direction along a line in a direction from top to bottom of the sheet material and a horizontal concave curvature relative to the horizontal direction generally between the top and bottom of the sheet material; the vertical concave curvatures being different and the horizontal concave curvatures being different.

According to another aspect, relative to a line drawn between the top and bottom of the sheet material, an area of the sheet material at and in proximity to the juncture of the upper portion and lower portion protrudes in a convex manner relative to the forward direction.

According to another aspect, the seat back further includes a mounting support that is relatively rigid compared to the resiliently flexible sheet material, the mounting support attached to the back of the sheet material in proximity to the respective side edges.

According to another aspect, the mounting support includes a relatively rigid generally U-shape support having a pair of tines respectively attached to the sheet material at the back of the sheet material proximate respective side edges of the sheet material.

According to another aspect, the top of the mounting support is below the top of the sheet material and provides a fulcrum effect about which the sheet material may bend in a backwards direction.

According to another aspect, the mounting support further includes an adapter configured to attach with a chair or other seating apparatus.

According to another aspect, the adapter includes a tongue member configured to attach the mounting support to a chair or other seating apparatus.

According to another aspect, the mounting support includes an open area within which part of the sheet material may move in response to deforming of the sheet material in response to pressure applied to the sheet material.

According to another aspect, the upper portion is resiliently deformable to bend to an angle that is approximately at ninety degrees to the lower portion.

According to another aspect, in response to pressure applied to one side portion upper portion but not to the other side portion, the one side portion bends sidewise relative to the other side portion.

According to another aspect, a seating apparatus includes a seat, a base and a seat back according to the above aspects.

According to another aspect, a method of exercising while seated, includes sitting in a seating apparatus according to the above aspects, and using parts of the body to apply pressure to respective portions of the seat back to resiliently deform and to release the sheet material.

According to another aspect a chair back support includes a frame; a body disposed within the frame; wherein the frame and the body include a lower portion having a first curvature and an upper portion having a second curvature of different magnitude and direction; wherein the support portion and the lower portion are flexible relative to each other; wherein the upper portion and the lower portion meet at a juncture; and wherein the chair back flexes at a transition area between the first curvature and the second curvature.

To the accomplishment of the foregoing and the related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be suitably employed.

Other systems, methods, features, and advantages of the invention will be or become apparent to one with skill in the art upon examination of the following drawings and detailed description. It is intended that all such additional systems, methods, features, and advantages be included within this description, be within the scope of the present invention, and be protected by the accompanying claims.

Although the invention is shown and described with respect to one or more embodiments, it is to be understood that equivalents and modifications will occur to others skilled in the art upon the reading and understanding of the specification. The present invention includes all such equivalents and modifications, and is limited only by the scope of the claims.

Also, although the various features are described and are illustrated in respective drawings/embodiments, it will be appreciated that features of a given drawing or embodiment may be used in one or more other drawings or embodiments of the invention.

It should be emphasized that the term "comprise/comprising" when used in this specification is taken to specify the presence of stated features, integers, steps or components but does not preclude the presence or addition of one or more other features, integers, steps, components or groups thereof.

In the interest of brevity, an example of the seat back as used in a seating apparatus is presented, the seating apparatus being in the form of a chair. It will be appreciated, though, that the chair is but one example of a seating apparatus in which the seat back may be used; other types of chairs may employ the seat back and are understood to be included in the reference to and exemplary illustration of the chair that is illustrated in the drawings and described herein in detail. Moreover, the seating apparatus may be in a form other than a chair, such as a stadium or theater seat, a couch, easy chair, lounge chair, stool, and so on. The terms chair and seating apparatus are inclusive of all of these and equivalents thereof.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Likewise, elements and features depicted in one drawing may be combined with elements and features depicted in additional drawings. Moreover, in the drawings, like reference numerals designate corresponding parts throughout the several views and primed reference numerals designate parts that are similar to parts designated by the same unprimed reference numerals.

In the annexed drawings.

DESCRIPTION

Figure 1:
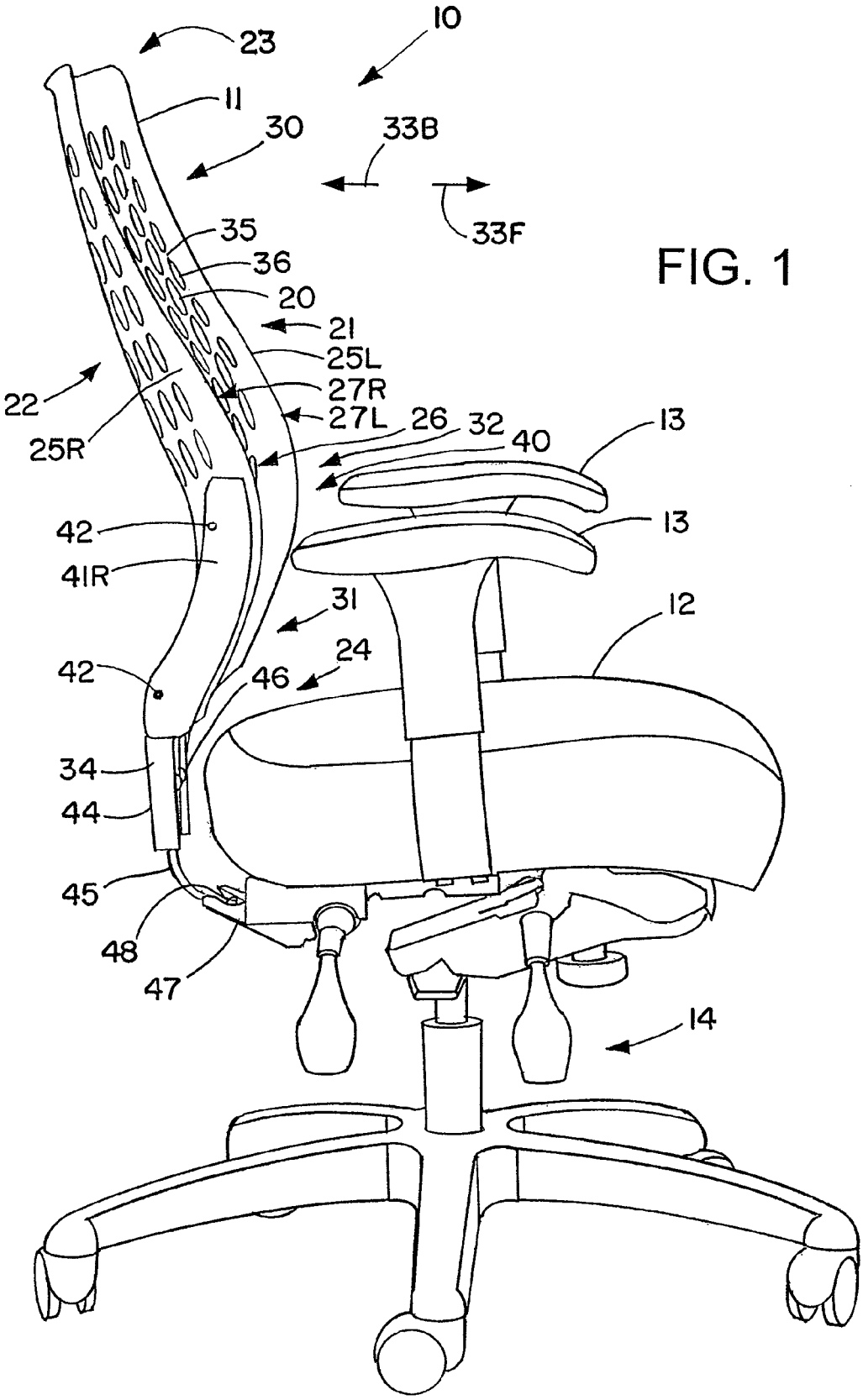
FIG. 1 is a side view, partly in perspective, of a chair with a seat back, which is upright, the chair and seat back facing in a forward direction, which in the illustration is to the right.

Referring, now, to the drawings, like reference numerals refer to like parts in the several figures and primed reference numerals may refer to parts that are similar to parts that are designated by the same unprimed reference numerals.

Figure 2:
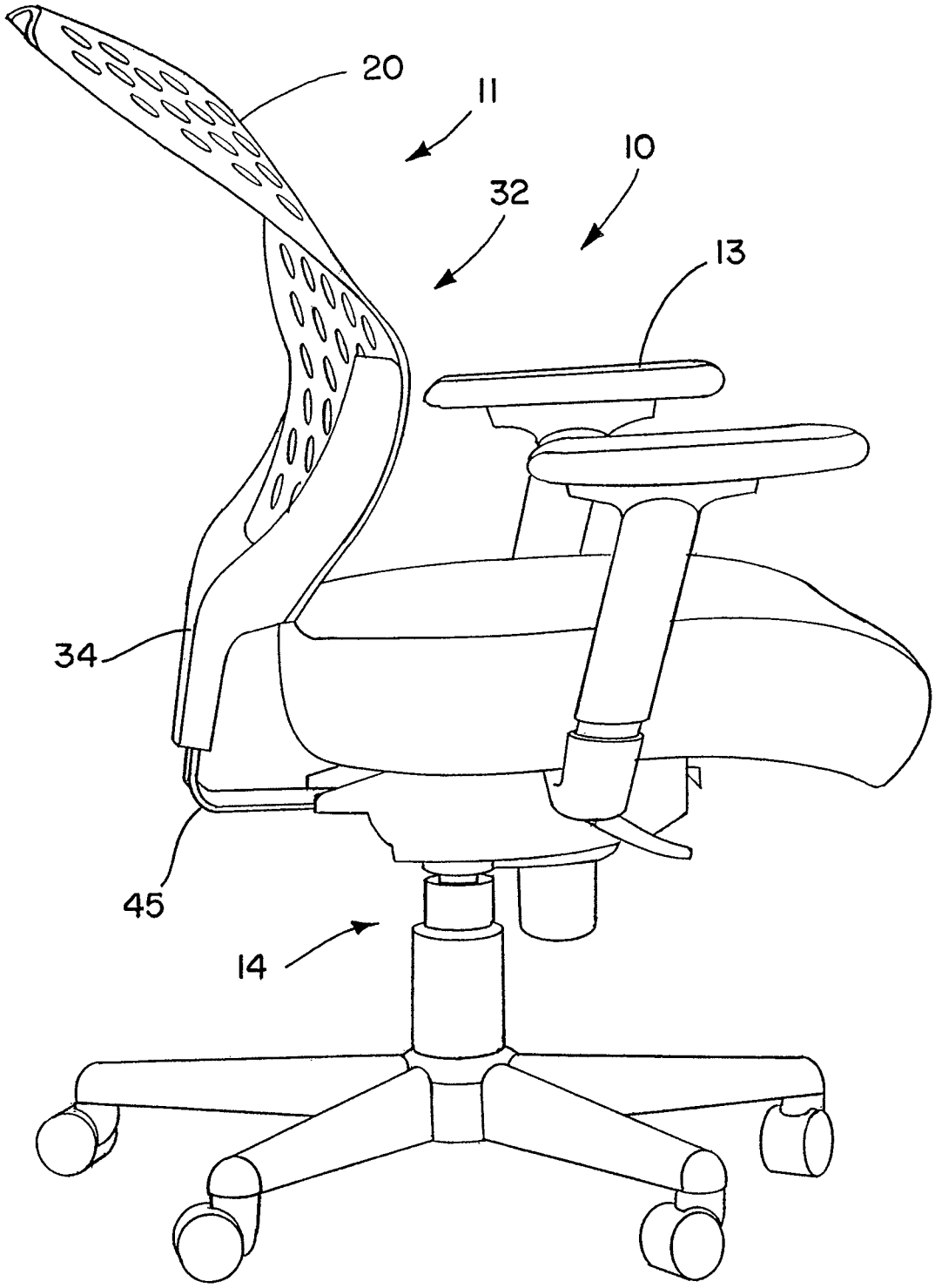
FIG. 2 is a side view, partly in perspective, of a chair with a seat back, which are facing in a forward direction but with part of the seat back partly bent in a backwards direction.
Figure 3:
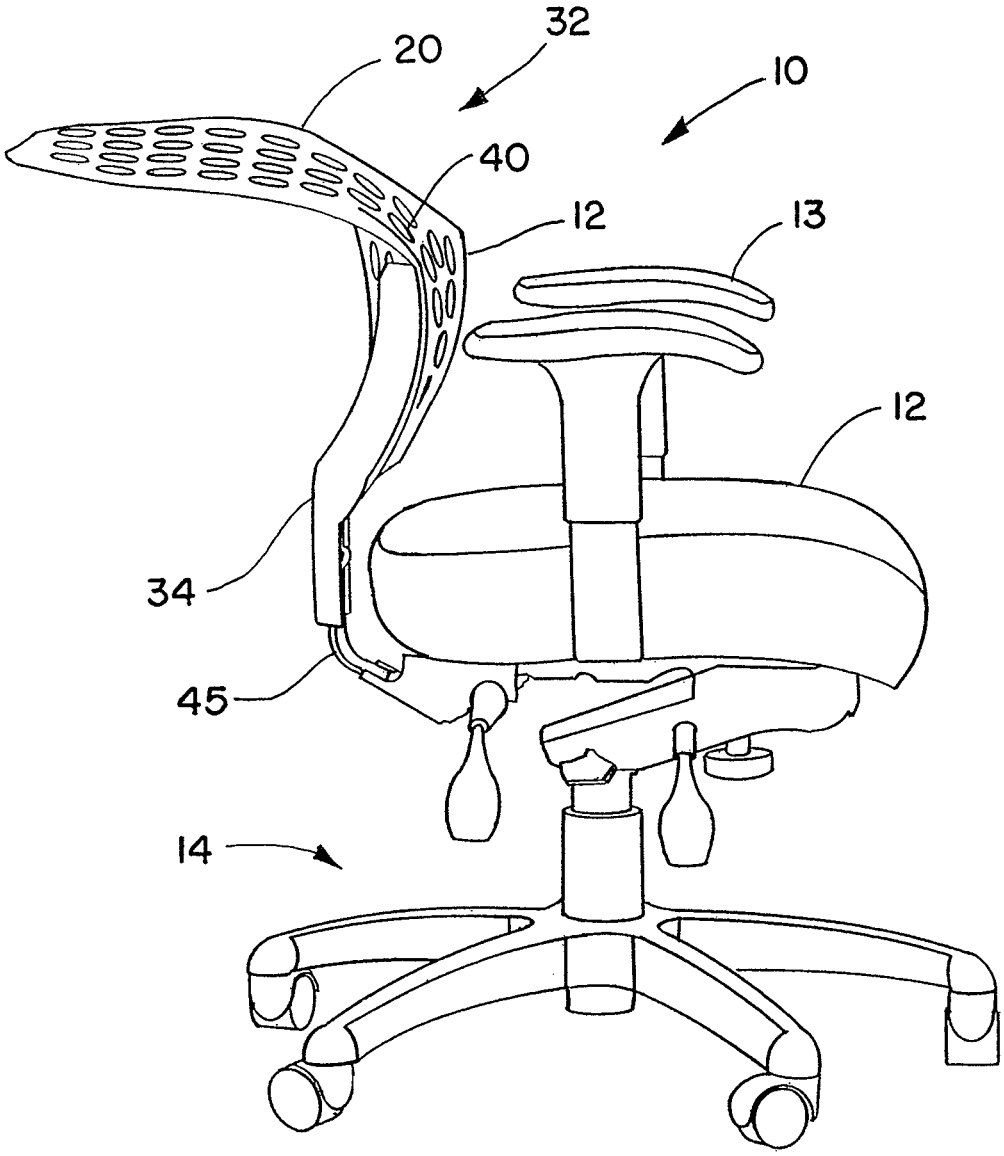
FIG. 3 is a side view similar to FIG. 2, but with part of the seat back bent further in a backwards direction to approximately a right angle relative to the vertical upright direction illustrated in FIG. 1.

In FIGS. 1-3 a chair 10 (FIG. 1) and 10' (FIGS. 2 and 3) having a seat back 11 a seat 12, arm rests 13 and a base 14 is illustrated. In FIGS. 2 and 3 the chair 10' is slightly different from the chair 10 in FIG. 1, e.g., the chairs have slightly different style bases and style arm rests, but for purposes of this disclosure the chairs are considered as though the same and will be referred to below as the chair 10 in FIG. 1. The chair may be of many different designs and shapes with or without arm rests, with various bases or other support mechanism on which the seat 12 rests or is supported, and so on; the seat back 11 may be adapted for use with many different types of chairs.

The seat back 11 is an integral sheet material 20. The sheet material 20 has rigidity sufficient to maintain its shape in the absence of a deforming force, e.g., to maintain its upright shape and orientation as shown in FIG. 1. Also, the sheet material 20 is resiliently flexible to permit limited (controlled) deformation during use generally in a prescribed manner in response to force applied thereto by a user tending to bend the upper portion of the sheet material relative to the lower portion of the sheet material in a direction front to back and/or in a sidewise direction while supporting the back of the user. Such deformation part way is illustrated in FIG. 2 and is illustrated more completely in FIG. 3.

Briefly, in using a chair 10 having a seat back 11, as is disclosed herein, a person may sit in the chair and lean in a normal way against the seat back, as the seat back provides comfortable upright support to the person's back. However, if desired, the person seated in the chair 10 may lean back backward against the seat back 11 to deform it part way, e.g., as is illustrated in FIG. 2, or may lean backward even further to deform the seat back to make an approximately right angle (90 degree) bend relative to upright orientation. During such deforming or bending of the seat back 11, the bottom of the seat back is held securely in relatively fixed orientation and attachment with respect to the chair base and seat that is on the chair base. Also, during such deforming or bending of the seat back 11, the seat back continues to provide a measure of support to the person's back, and since a substantial weight of the person continues to press down or to be pulled down by gravity against the seat and chair base, the chair maintains stability and does not fall over as the person leans backward.

In addition to direct backward deformation, the seat back may be deformed in a sidewise direction. For example, if a person were to lean with more force against one side, e.g., right side of the seat back with a stronger force than leaning against the left side or if a person were somewhat to roll toward one side or the other of the seat back, that side of the seat back would tend to bend in a backward direction while the other side would bend less or not bend at all. As was described above, while undergoing such sidewise deforming or bending of the seat back 11, the seat back still would continue to provide a measure of support to the person's back, and since a substantial weight of the person continues to press down or to be pulled down by gravity against the seat and chair base, the chair maintains stability and does not fall over as the person leans backward.

It will be appreciated that the chair 10 may be used in conventional manner with the seat back 11 generally upright (FIG. 1) to provide support for the back of a person seated in the chair. Additionally, the chair 10 may be used to provide seating for a person while the person stretches leaning part way or more straight backward in the chair (FIGS. 2 and 3) or may lean sidewise in the chair (not shown). Such stretching may provide a measure of relaxation and/or stress relief; and such stretching may be done in a way that provides some exercise to the user.

As is seen in FIG. 1, the seat back 11 is upright, and the chair 10 and seat back are facing in a forward direction, which in the illustration is to the right. The seat back 11 is an integral sheet material 20 having a front 21 and a back 22 and having a top 23, a bottom 24, a pair of side edges 25L, 25R, and a center portion 26 between the side edges. The sheet material 20 has rigidity sufficient to maintain its shape in the absence of a deforming force.

The sheet material 20 has side portions 27L, 27R extending from proximity to respective side edges 25L, 25R at least part way toward the center portion 26. The side portions are curved concave relative to a forward direction from an area relatively more proximate the center portion 26 toward the respective side edges. With respect to the illustration in FIG. 1 in which the seat back 11 is unstressed (unbent by external force), the structure of the seat back may be described relative to a vertical line drawn from the top 23 toward the bottom 24 of the sheet material in the illustration of FIG. 1, as being concave in the forward direction, as can be seen in the drawings.

The sheet material 20 has relatively upper and lower portions 30, 31 considered in a direction from the top 23 toward the bottom 24, an area of the sheet material approximately at the juncture 32 of the upper and lower portions 30, 31 protruding more forwardly than the major extent of the upper and lower portions.

Also, the sheet material 20 is resiliently flexible to permit limited (controlled) deformation during use generally in a prescribed manner in response to force applied thereto by a user tending to bend the upper portion of the sheet material relative to the lower portion of the sheet material in a direction front to back (i.e., the relative "backward direction" represented by arrow 33B—the forward direction is represented by the arrow 33F) and/or in a sidewise direction while supporting the back of the user. The permitted deformation, also referred to as bending or flexing, is controlled in in part by the shape, rigidity and flexibility characteristics of the seat back 11 and also by cooperation between the sheet material and the mounting support 34, which is described further below. In FIG. 2 the seat back 11 of the chair 10 is partly bent or flexed in a backward direction; and in FIG. 3 the seat back 11 is bent or flexed backward even further so that the upper portion 30 is approximately at a right angle relation to the lower portion 31. Such bending or flexing of the seat back 11 may be caused, for example, by a person, who is sitting on the seat 12, leaning against the seat back to apply force or pressure against the seat back.

The flexible sheet material 20 of which the seat back 11 is made may be made of a plastic material. Exemplary materials are listed below; other materials that exist or may be developed in the future also or alternatively may be used. The flexible sheet material 20 may be in the form of a lattice structure having strut-like areas 35 surrounding respective open spaces 36. Alternatively, the flexible sheet material may be a substantially solid sheet, or it may have solid areas and open areas other than in a lattice format; or the flexible sheet material may be of some other form or configuration.

The material of which the flexible sheet material 20 is made may have a suitable modulus of elasticity or some other mechanical characteristic or property that provides for the desired bending, resistance to bending, return from bent position to normal unbent position or orientation, and so on. As an example, the seat back 11 and flexible material 20 thereof are responsive to force applied to the back, e.g., by a person, who is sitting on the chair 10, leaning backward and, thus, applying weight and pressure to the seat back.

The sheet material 20 may be made by injection molding technique or by some other technique.

Exemplary materials of which the sheet material 20 may be made and which are useful in injection molding techniques include the following:

Polypropylene (PP), also known as polypropene, which is a thermoplastic polymer used in a wide variety of applications.

Polystyrene (PS), which is an aromatic polymer made from the monomer styrene, a liquid petrochemical. Polystyrene is one of the most widely used plastics.

Polycarbonates (PC), also identified/known by the trademarks LEXAN, MAKROLON, MAKROCLEAR and others; this is a particular group of thermoplastic polymers. They are easily worked, molded and thermoformed.

Thermoplastic elastomers (TPE), which sometimes are referred to as thermoplastic rubbers; these are a class of copolymers or a physical mix of polymers (usually a plastic and a rubber) which consist of materials with both thermoplastic and elastomeric properties.

Further, the configuration of the flexible sheet material 20 may be such as to provide a desired resilience, flexibility and resistance to bending or flexing so as to have a "designed in" bending or flexing characteristic. For example, compare FIGS. 4A and 4B, which are schematic horizontal cross sections through exemplary seat backs 11*a*, 11*b*. The flexible sheet material 20*a* of a seat back 11*a* has left and right side portions 27L, 27R that are more perpendicular to the major generally planar extent of the seat back center portion 26 and the flexible sheet material 20*b* of a seat back 11*b* has left and right side portions 27L, 27R that are more nearly continuous, almost parallel with the seat back center portion 26. If all other characteristics of the flexible sheet materials 20*a*, 20*b* and seat backs 11*a*, 11*b* were the same or at least substantially the same, the more perpendicular side portions 27L, 27R of the seat back 11*a* would tend to provide greater resistance to bending of the flexible sheet material 20*a* than the seat back 11*b* and flexible sheet material 20*b*. It will be appreciated that other configuration features may be designed in the flexible sheet material to alter the bending or flexing characteristics thereof, e.g., to affect the needed force or pressure to bend the flexible sheet material.

The thickness of the major extent of the flexible sheet material 20 may be at least approximately uniform. However, the thickness may be designed to provide for desired flexibility and bending (or resistance to bending) characteristics. Also, the flexible sheet material 20 may have an increased thickness at areas near and at the perimeter, e.g., at the side portions 27L, 27R as well as at the upper portion 30 and lower portion 31, to provide strength reinforcement at those areas. For example, the perimeter 20*p* or at least part of the perimeter of the flexible sheet material 20 may be thicker or may be formed to have a characteristic to be stiffer or stronger than is the center portion 26 of the flexible sheet material. The thickened portions of the flexible sheet material about the perimeter of the flexible sheet material alone or together with one or more other parts (not shown) and/or with the mounting support 34 provide a frame 20*f* about the major body extent of the flexible sheet material 20, including the upper and lower portions 30, 31. The juncture 32 of the of the upper and lower portions and the parts of the flexible sheet material 20 in proximity to the juncture above and/or below the juncture provide a transition area about where between the different curvatures of the upper and lower portions 31, 32. In operation or use of the chair back 11, the chair back bends or flexes at the transition area.

Figure 4:
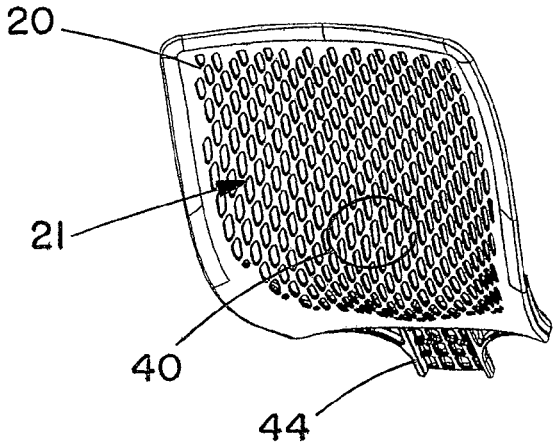
FIG. 4 is a front perspective view of the seat back in unbent condition, the view slightly looking at the seat back from the top left to show respective curvatures of the seat back.
Figure 5:
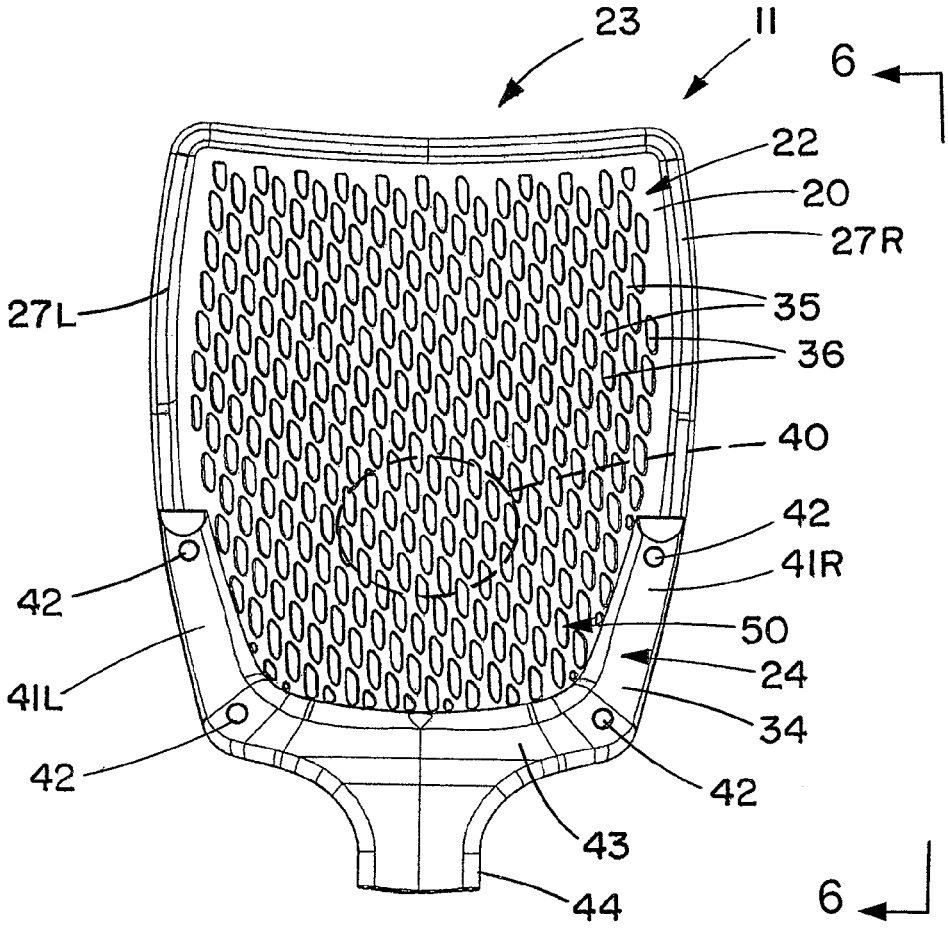
FIG. 5 is a rear elevation view of the seat back with a mounting support attached thereto.
Figure 6:
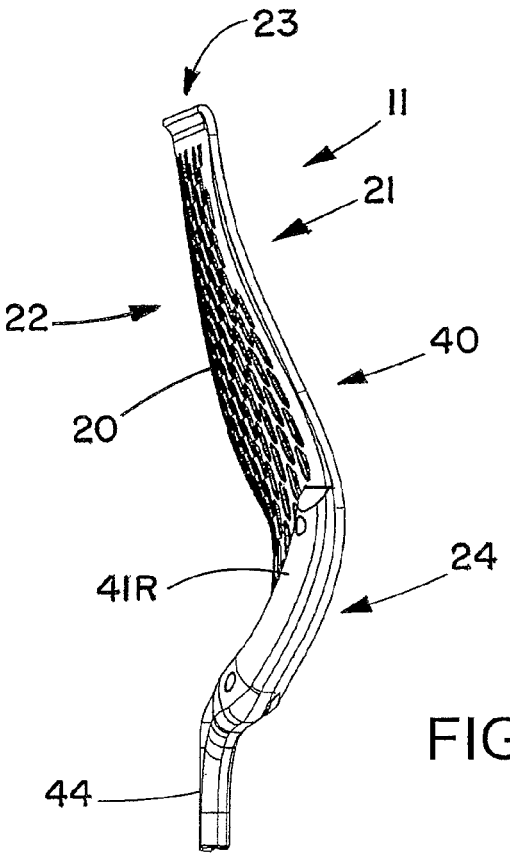
FIG. 6 is a side elevation view of the seat back with mounting support looking in the direction of the arrows 6-6 of FIG. 5.
Figure 7:
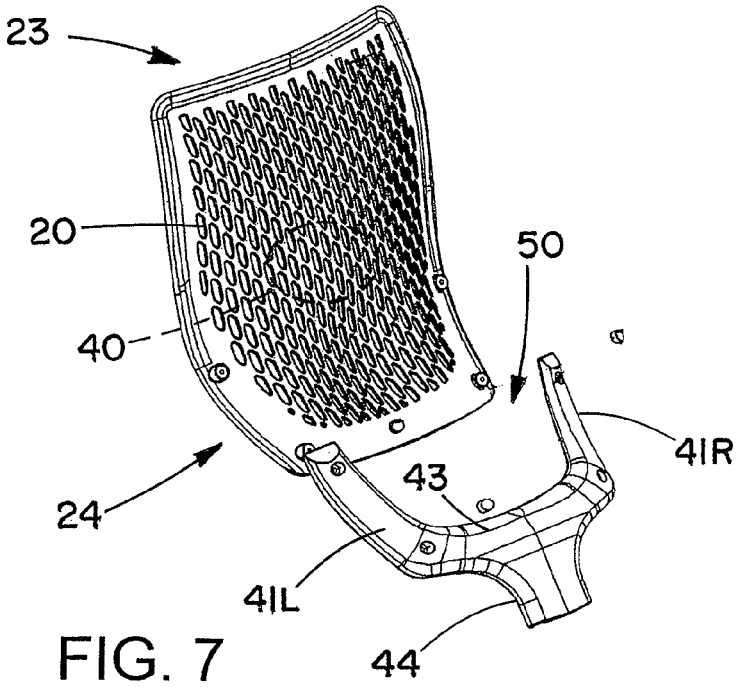
FIG. 7 is an exploded isometric back view of the seat back with mounting support.
Figure 8:
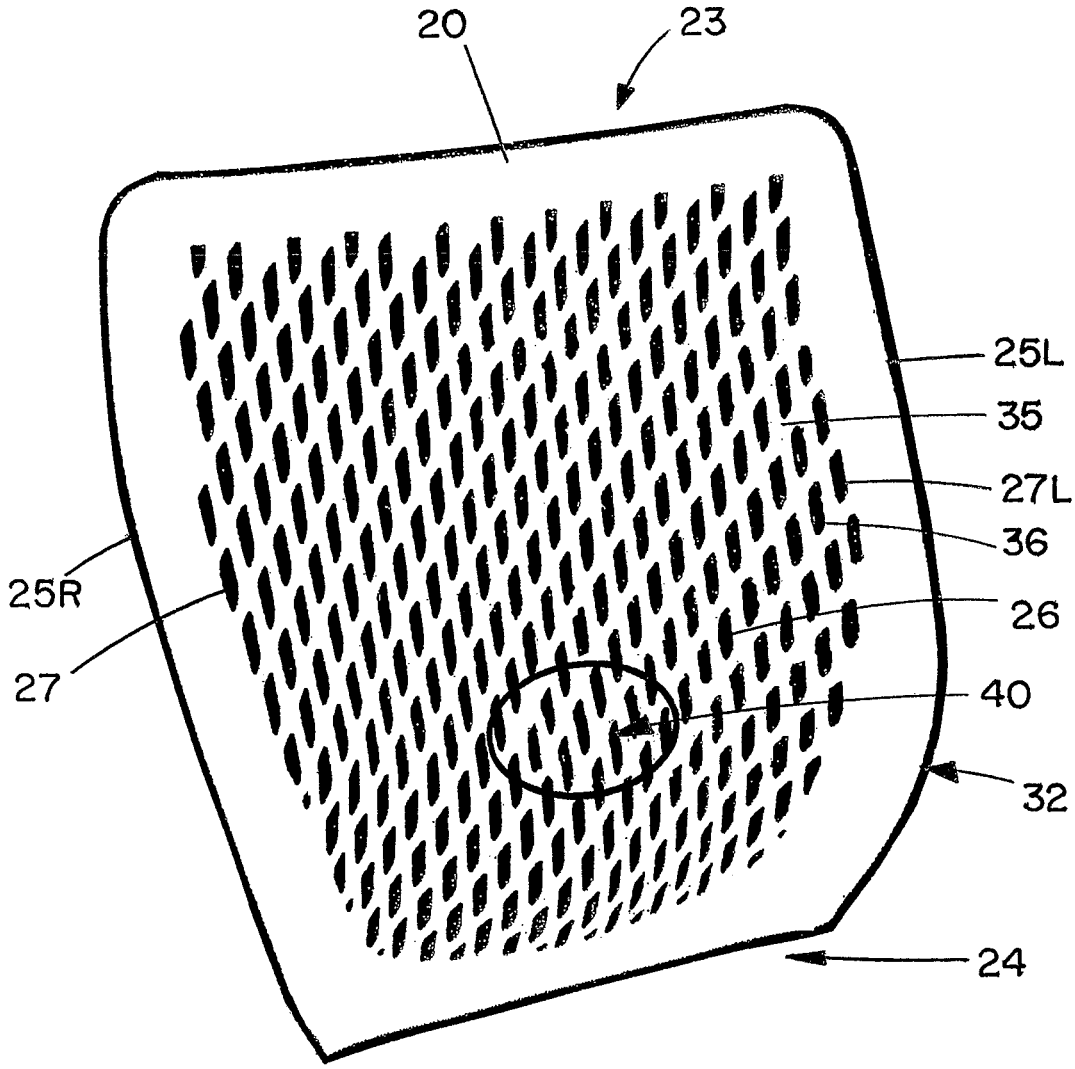
FIG. 8 is a perspective view of the flexible sheet material showing location of the lumbar support.
Figure 9:
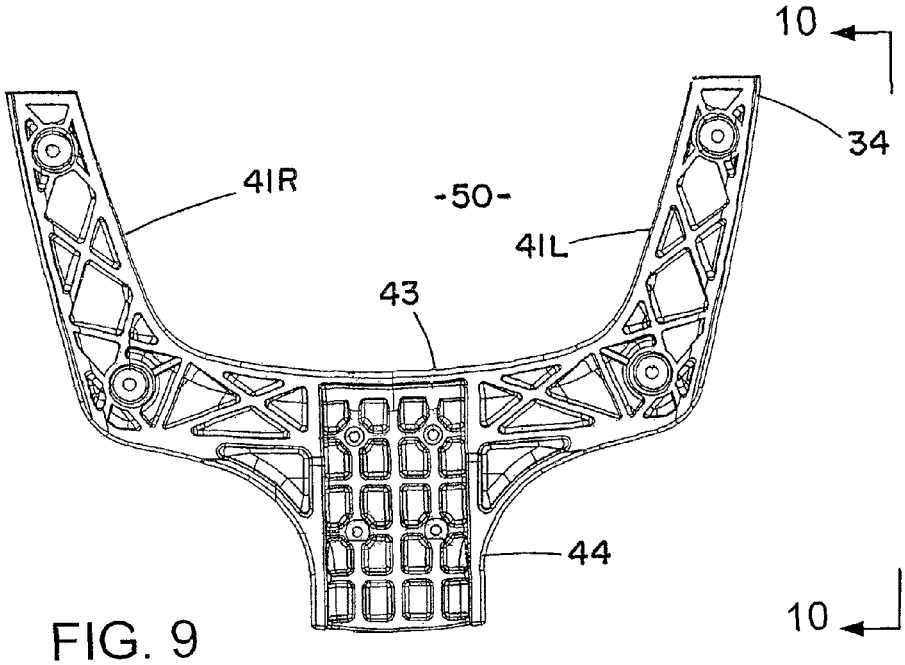
FIG. 9 is a front elevation view of the mounting support of the seat back.
Figure 10:
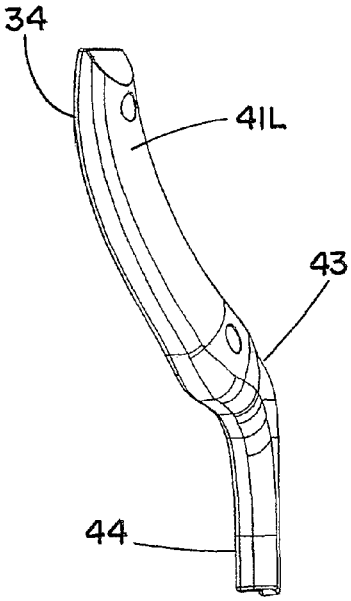
FIG. 10 is a side elevation view of the mounting support looking in the direction of the arrows 10-10 of FIG. 9.
Figure 11:
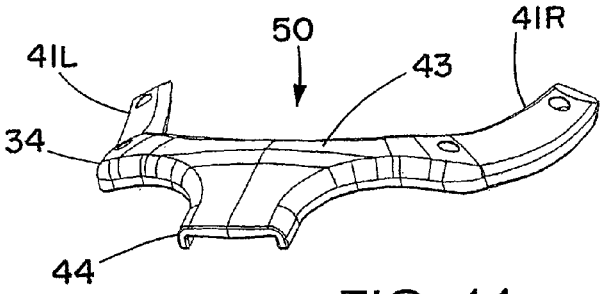
FIG. 11 is a rear perspective view of the mounting support.
Figure 12:
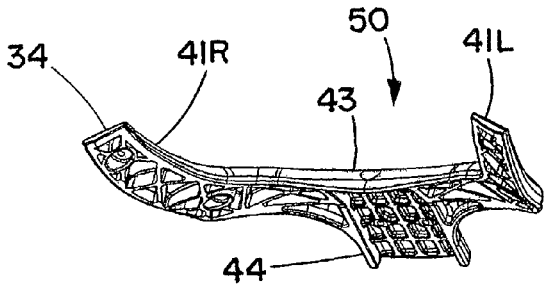
FIG. 12 is a front perspective view of the mounting support, the view slightly looking at the mounting support from the top left to show respective curvatures and bends thereof.

Briefly referring to FIGS. 4-8 the seat back 11 is shown in detail. In FIGS. 4 and 8, which are front views of the seat back 11 and of the flexible sheet material 20, a lumbar support 40 is seen as a protruding area at the center portion 26. The lumbar support may be approximately centered between the left and right sides 25L, 25R and is located between the top 23 and bottom 24 of the flexible sheet material 20. The lumbar support 40 may have a width that is approximately one fourth the width of the flexible sheet material 20 at the area of the juncture 32 between the upper and lower portions 30, 31. The lumbar support 40 may slope gradually from approximately the plane of the flexible sheet material adjacent the lumbar support to the peak of the lumbar support; thus, the lumbar support may be somewhat dome-shape facing forward from the major planar extent of the adjacent area of the flexible sheet material. Alternatively, the lumbar support 40 may be of another shape, e.g., extending horizontally as a raised generally linear ridge at an area between the left and right sides 25L, 25R; the horizontal length of the generally linear ridge extending short of reaching the left and right sides. Thus, it will be appreciated that the lumbar support 40 protrudes in a forward direction (opposite the direction of the front to back arrow 33B). The lumbar support provides added comfort to a person who is sitting in the chair 10 by pressing toward the back of the person.

The relatively upper portion 30 of the flexible sheet material 20 of the seat back 11 has a vertical concave curvature relative to the forward direction along a line in a direction from top 23 to bottom 24 of the flexible sheet material, i.e., the center part of the upper portion 30 "sinks in" in the direction of the arrow 33B (FIG. 1) relative to the side portions 27L, 27R. The relatively lower portion 31 of the flexible sheet material 20 has a vertical concave curvature relative to the forward direction along a line in a direction from top to bottom of the sheet material and a horizontal concave curvature relative to the horizontal direction generally between the top 23 and bottom 24 of the flexible sheet material. The vertical concave curvatures are different from each other and the horizontal concave curvatures also are different from each other. Thus, as is seen in the drawings, the seat back 11 tends to have a shape that would slightly wrap around the back of a person sitting in the chair 10 as compared to a flat seat back.

As is seen in the drawings, relative to a line drawn between the top 23 and bottom 24 of the flexible sheet material 20, an area of the flexible sheet material at and in proximity to the juncture 32 of the upper and lower portions 30, 31 tends to protrude in a convex manner relative to the forward direction 33F (see arrow 33F in FIG. 1). Such protruding is provided on account of the different curvatures and the relative directional orientations of the major extents of the respective upper and lower portions 30, 31 of the flexible sheet material 20.

Referring to FIGS. 1-8 and also to FIGS. 9-12, a mounting support 34 that is relatively rigid compared to the resiliency of the flexible sheet material 20 is attached to the back 22 of the flexible sheet material in proximity to the left and right sides 25L, 25R. The mounting support 34 may be made of relatively rigid or stiff material such as, for example, a strong and durable plastic or a metal. Exemplary other materials of which the mounting support may be made include a polymer, plastic, and so on. Exemplary metal materials for the mounting support include aluminum, steel, stainless steel, or some other metal. As is seen in FIGS. 4-10, the mounting support is generally U-shape and has a pair of tines or prongs 41L, 41R each of which is attached to the flexible sheet material 20 at a respective left and right side 25L, 25R. The tines 41L, 41R may be attached to the back of the flexible sheet material 20, may slightly wrap around from the back toward the front of the flexible sheet material or may be attached in some other manner to the flexible sheet material. Fasteners, e.g., screws or bolts 42, or some other fastening material or device, may be used to secure the flexible sheet material 20 to the tines 41L, 41R of the mounting support 34. The tines are connected together by a bridge portion 43 of the U-shape mounting support; and a connector stem or tongue 44 extends from the bridge portion 43 downward to connect the seat back 11 to the chair 10 base 14 via an adapter 45.

In an embodiment the mounting support 34 is relatively inflexible as compared to the flexibility of the flexible sheet material 20, so that in using the chair 10, as a person leans back against the upper portion 30 of the seat back 11, the flexible sheet material bends, while the mounting support maintains its relatively rigid shape. The mounting support 34 is attached to the flexible sheet material 20 such that the top of the tines 41L, 41R or the area of the flexible sheet material at and/or slightly above the top of the tines at approximately the juncture 32 between the upper and lower portions 30, 31 of the flexible sheet material provides a fulcrum effect about which the flexible sheet material may bend. As is described above, such bending may be in a backwards direction in response to force or pressure applied, for example, by a person leaning backwards in the chair 10; and the bending may be in a forward direction in response to the resilience or spring constant of the flexible sheet material as the user releases the force or pressure, e.g., by leaning forward relative to the backward leaning mentioned.

The adapter 45 is secured to the connector stem 44 by fasteners 46, e.g., screws, bolts or some other fastener. The adapter has a form factor (shape or configuration) suitable to attach the mounting support 34 to a suitable fitting 47 of the chair base 14. Different adapters may be used to attach the seat back 11 to the chair base 14, to the chair seat 12 or otherwise to secure the seat back as part of the chair 10 or other seating apparatus. Fasteners 48 secure the adapter to the fitting 47. The adapter 45 may be sufficiently rigid so that it would not ordinarily bend as a person were to lean backward against the seat back 11. However, if desired, the adapter 45 and/or part of the mounting support 34 may have some degree of resilience or resilient flexibility, e.g., as spring metal material or the like, to permit a tilting back of the seat back independently of or in conjunction with the bending of the flexible sheet material 20.

The mounting support 34 includes an open area 50 between the tines 41L, 41R, and within that open area part of the flexible sheet material 20 may move in response to deforming (bending or flexing) of the sheet material as pressure or force is applied to and removed from the flexible sheet material, as is described above.

In using the chair 10 with the seat back 11, a person may sit on the chair and the seat back 11 provides generally vertical (or slightly angular) support for the person's back, as the person sits generally upright in the chair, e.g., as is illustrated in FIG. 1. As the person leans backward in the chair 10 the seat back 11 bends backward to an extent depending on force and spring constants associated with the seat back and the flexible sheet material 20 thereof, e.g., as is illustrated in FIGS. 2 and 3. The person may lean sidewise, too, and tend to cause bending of the flexible sheet material 20 in a sidewise manner. During the described leaning and bending of the flexible sheet material the seat back provides a measure of support for the user, as the user continues to sit on the seat 12 of the chair 10.

The chair 10 with the seat back 11 may be used by a person for exercising while seated. For example, a person sitting on the seat 12 of the chair 10 may lean backward and/or sidewise to apply force to a relatively upper portion 30 of the seat back to resiliently bend the seat back in a backward direction relative to a lower portion of the seat back. Such applying of force requires use of muscles of the person seated in the chair and, thus, exercises the muscles—possibly both the back muscles and other muscles of the person's body. Additionally, while the person is exercising, the chair maintains steady support for the user. The bending may occur about a fulcrum area, e.g., about at the juncture 32 of the seat back flexible sheet material 20. Further, exercise may be provided not only by the backward bending action but also by controlled rising to an upright sitting position and orientation of the user's back so as to resist the tendency of the seat back to come to a relatively upright orientation.

Generally, in using the seat back 11 and the chair 10 including the seat back, a user may selectively apply pressure or force to an upper portion of the seat back to resiliently flex or bend the seat back in a backward direction and then to release the seat back, whereupon the seat back returns to its unflexed or unbent orientation such as that shown, for example, in FIG. 1.

Figure 13:
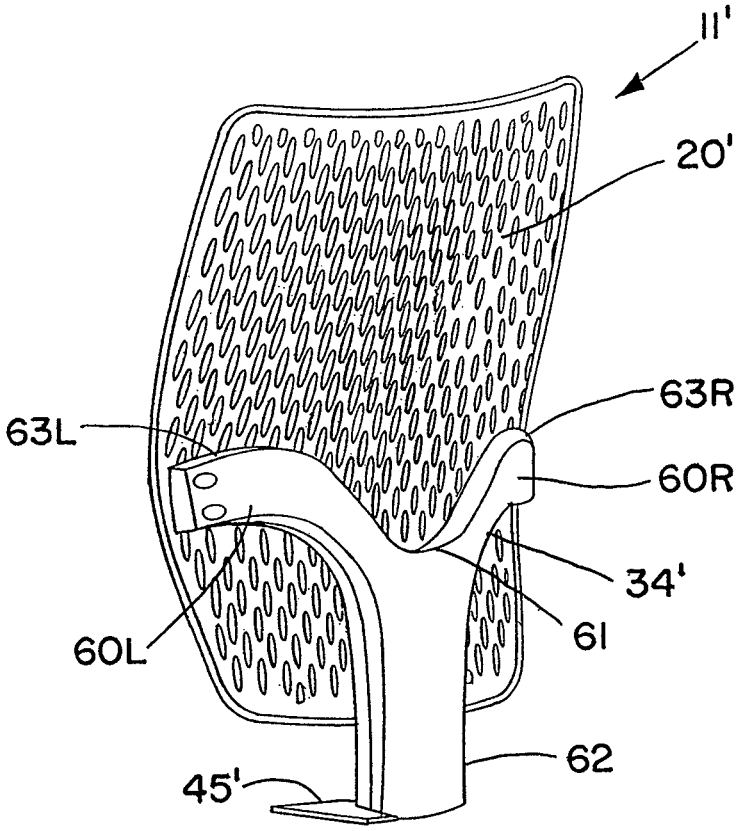
FIG. 13 is a back perspective view of a seat back with another embodiment of mounting support.

Briefly referring to FIG. 13, another embodiment of seat back 11' is illustrated. The seat back 11' includes a flexible sheet material 20' that is the same as or similar to flexible sheet material 20, which is described above. However, an alternative embodiment of mounting support 34' is shown in FIG. 13. The mounting support 34' is in a Y-shape having a pair of arms 60L, 60R, a connecting bridge 61 connected to the arms, and a connector stem 62. The function of the respective arms 60L/60R is similar to the function of the tines 41L, 41R, which are described above, namely, to mount the flexible sheet material ultimately to a chair base 14, for example, and to provide a surface 63L, 63R to cooperate with the flexible sheet material 20' in forming a fulcrum about which the flexible sheet material may bend. The connector stem 62 is provided as the connector stem 44, which is described above, to mount the seat back directly or via an adapter 45' to a chair base, such as chair base 14.

The embodiments claimed are, as follows:

1. A seat back, comprising an integral sheet material having a front and a back and having a top, a bottom, a pair of side edges, and a center portion between the side edges, the sheet material having rigidity sufficient to maintain a shape in an absence of a deforming force, the sheet material having side portions extending from proximity to respective side edges at least part way toward the center portion, the side portions curved concave relative to a forward direction from an area proximate the center portion toward the respective edges, the sheet material having upper and lower portions considered in a direction from the top toward the bottom, an area of the sheet material approximately at a juncture of the upper and lower portions protruding more forwardly than the major extent of the upper and lower portions, the sheet material being resiliently flexible to permit limited deformation during use generally in a prescribed manner in response to force applied thereto by a user tending to bend the upper portion of the sheet material relative to the lower portion of the sheet material in a direction front to back while supporting the back of the user, wherein such force causes the upper portion of the sheet to deform from concave relative to a forward direction from an area proximate the center portion toward the respective edges to convex relative to the forward direction from an area proximate the center portion toward the respective edges, and a mounting support that is more rigid than the resiliently flexible sheet material, the mounting support attached to the back of the sheet material in proximity to the respective side edges.

2. The seat back of claim 1, wherein the sheet material is a single sheet of plastic material.

3. The seat back of claim 1, wherein the sheet material has a lattice structure including open areas and closed areas.

4. The seat back of claim 1, wherein a thickness of the major extent of the sheet material is at least approximately uniform, and wherein there is a relatively increased thickness of the sheet material at least part of the perimeter thereof providing strength reinforcement at such perimeter.

5. The seat back of claim 1, further comprising a forwardly protruding part of the center portion between the top and bottom configured to provide a lumbar support area providing lumbar support for a user.

6. The seat back of claim 5, wherein the lumbar support area is a gradual smooth transition from the major extent of the sheet material in proximity to the lumbar support to the forwardly protruding part of the center portion of the sheet material.

7. The seat back of claim 5, wherein the center portion is approximately evenly centered between the side edges.

8. The seat back of claim 1, the upper portion having a vertical concave curvature relative to the forward direction along a line in a direction from top to bottom of the sheet material and a horizontal concave curvature relative to the horizontal direction generally between the top and bottom of the sheet material; and the lower portion having a vertical concave curvature relative to the forward direction along a line in a direction from top to bottom of the sheet material and a horizontal concave curvature relative to the horizontal direction generally between the top and bottom of the sheet material; the vertical concave curvatures being different and the horizontal concave curvatures being different.

9. The seat back of claim 8, wherein relative to a line drawn between the top and bottom of the sheet material, an area of the sheet material at and in proximity to the juncture of the upper portion and lower portion protrudes in a convex manner relative to the forward direction.

10. The seat back of claim 1, wherein the mounting support comprises a rigid generally U-shape support having a pair of tines respectively attached to the sheet material at the back of the sheet material proximate respective side edges of the sheet material.

11. The seat back of claim 1, wherein the top of the mounting support is below the top of the sheet material and provides a fulcrum effect about which the sheet material is adapted to bend in a backwards direction.

12. The seat back of claim 11, wherein the mounting support further comprises an adapter configured to attach with a chair or other seating apparatus.

13. The seat back of claim 12, wherein the adapter includes a tongue member configured to attach the support to a chair or other seating apparatus.

14. The seat back of claim 11, wherein the support includes an open area within which part of the sheet material may move in response to deforming of the sheet material in response to pressure applied to the sheet material.

15. The seat back of claim 1, wherein the upper portion is resiliently deformable to bend to an angle that is approximately at ninety degrees to the lower portion.

16. The seat back of claim 1, wherein in response to pressure applied to one side portion upper portion but not to the other side portion, the one side portion bends sidewise relative to the other side portion.

17. A seating apparatus comprising a seat, a base, and a seat back of claim 1.

18. A method of exercising while seated, comprising sitting in the seating apparatus of claim 17, and using parts of the body to apply pressure to respective portions of the seat back to resiliently deform and to release the sheet material.

19. A chair back support, comprising:

a frame;

a body disposed within the frame;

wherein the frame and the body include a lower portion having a first curvature and an upper portion having a second curvature of different magnitude and direction than the first curvature;

wherein the upper portion and the lower portion are flexible relative to each other;

wherein the upper portion and the lower portion meet at a juncture; and wherein the chair back flexes at a transition area between the first curvature and the second curvature;

wherein prior to flexing at the transition area the second curvature is concave relative to a forward direction; and wherein after flexing at the transition area the second curvature is convex relative to a forward direction.

20. A seat back, comprising an integral sheet material having a front and a back and having a top, a bottom, a pair of side edges, and a center portion between the side edges, the sheet material having rigidity sufficient to maintain its shape in an absence of a deforming force, the sheet material having side portions extending from proximity to respective side edges at least part way toward the center portion, the side portions curved concave relative to a forward direction from an area proximate the center portion toward the respective edges, the sheet material having upper and lower portions considered in a direction from the top toward the bottom, an area of the sheet material approximately at a juncture of the upper and lower portions protruding more forwardly than the major extent of the upper and lower portions, the sheet material being resiliently flexible to permit limited deformation during use generally in a prescribed manner in response to force applied thereto by a user tending to bend the upper portion of the sheet material relative to the lower portion of the sheet material in a direction front to back while supporting the back of the user, wherein such force causes the upper portion of the sheet to deform from concave relative to a forward direction from an area proximate the center portion toward the respective edges to convex relative to the forward direction from an area proximate the center portion toward the respective edges, the upper portion having a vertical concave curvature relative to the forward direction along a line in a direction from top to bottom of the sheet material and a horizontal concave curvature relative to the horizontal direction generally between the top and bottom of the sheet material;

the lower portion having a vertical concave curvature relative to the forward direction along a line in a direction from top to bottom of the sheet material and a horizontal concave curvature relative to the horizontal direction generally between the top and bottom of the sheet material; and the vertical concave curvatures being different and the horizontal concave curvatures being different.

21. The seat back of claim 20, wherein relative to a line drawn between the top and bottom of the sheet material, an area of the sheet material at and in proximity to the juncture of the upper portion and lower portion protrudes in a convex manner relative to the forward direction.

* * * * *